US009187858B2

(12) United States Patent
Hasanreisoğlu et al.

(10) Patent No.: US 9,187,858 B2
(45) Date of Patent: Nov. 17, 2015

(54) WASHING MACHINE WHEREIN THE UNBALANCED LOAD IS BALANCED

(75) Inventors: Ali Levent Hasanreisoğlu, Istanbul (TR); Celal Vatansever, Istanbul (TR); Nihat Gunduz, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 617 days.

(21) Appl. No.: 13/520,180

(22) PCT Filed: Dec. 17, 2010

(86) PCT No.: PCT/EP2010/070013
§ 371 (c)(1),
(2), (4) Date: Oct. 4, 2012

(87) PCT Pub. No.: WO2011/080119
PCT Pub. Date: Jul. 7, 2011

(65) Prior Publication Data

US 2013/0031939 A1 Feb. 7, 2013

(30) Foreign Application Priority Data

Dec. 31, 2009 (TR) ..... A 2009/10085

(51) Int. Cl.
*D06F 37/22* (2006.01)
*D06F 37/06* (2006.01)

(52) U.S. Cl.
CPC ..... *D06F 37/225* (2013.01); *D06F 37/06* (2013.01); *D06F 37/065* (2013.01)

(58) Field of Classification Search
CPC ..... D06F 37/225; D06F 37/06
USPC ..... 68/12.06, 23.2
See application file for complete search history.

(56) References Cited

U.S. PATENT DOCUMENTS

| | | | | | |
|---|---|---|---|---|---|
| 2,534,267 | A | * | 12/1950 | Kahn | 74/572.4 |
| 2,534,268 | A | * | 12/1950 | Ellner et al. | 74/572.4 |
| 2,534,269 | A | * | 12/1950 | Ellner et al. | 74/572.4 |
| RE24,140 | E | * | 4/1956 | Kahn | 74/572.4 |
| 5,280,660 | A | * | 1/1994 | Pellerin et al. | 8/158 |
| 5,582,040 | A | * | 12/1996 | Khan | 68/23.2 |
| 5,709,109 | A | * | 1/1998 | Cho | 68/23.2 |
| 5,893,280 | A | * | 4/1999 | Honda et al. | 68/12.06 |
| 2004/0083774 | A1 | * | 5/2004 | Kinouchi et al. | 68/23.1 |

* cited by examiner

*Primary Examiner* — Joseph L Perrin
(74) *Attorney, Agent, or Firm* — Venjuris P.C.

(57) ABSTRACT

The present invention relates to a washing machine (1) comprising one or more baffles (8) disposed at the inner surface of the side wall (4) wherein liquid is transferred for counterbalancing the unbalanced load when unbalanced load occurs.

15 Claims, 5 Drawing Sheets

WASHING MACHINE WHEREIN THE UNBALANCED LOAD IS BALANCED

Figure 1:
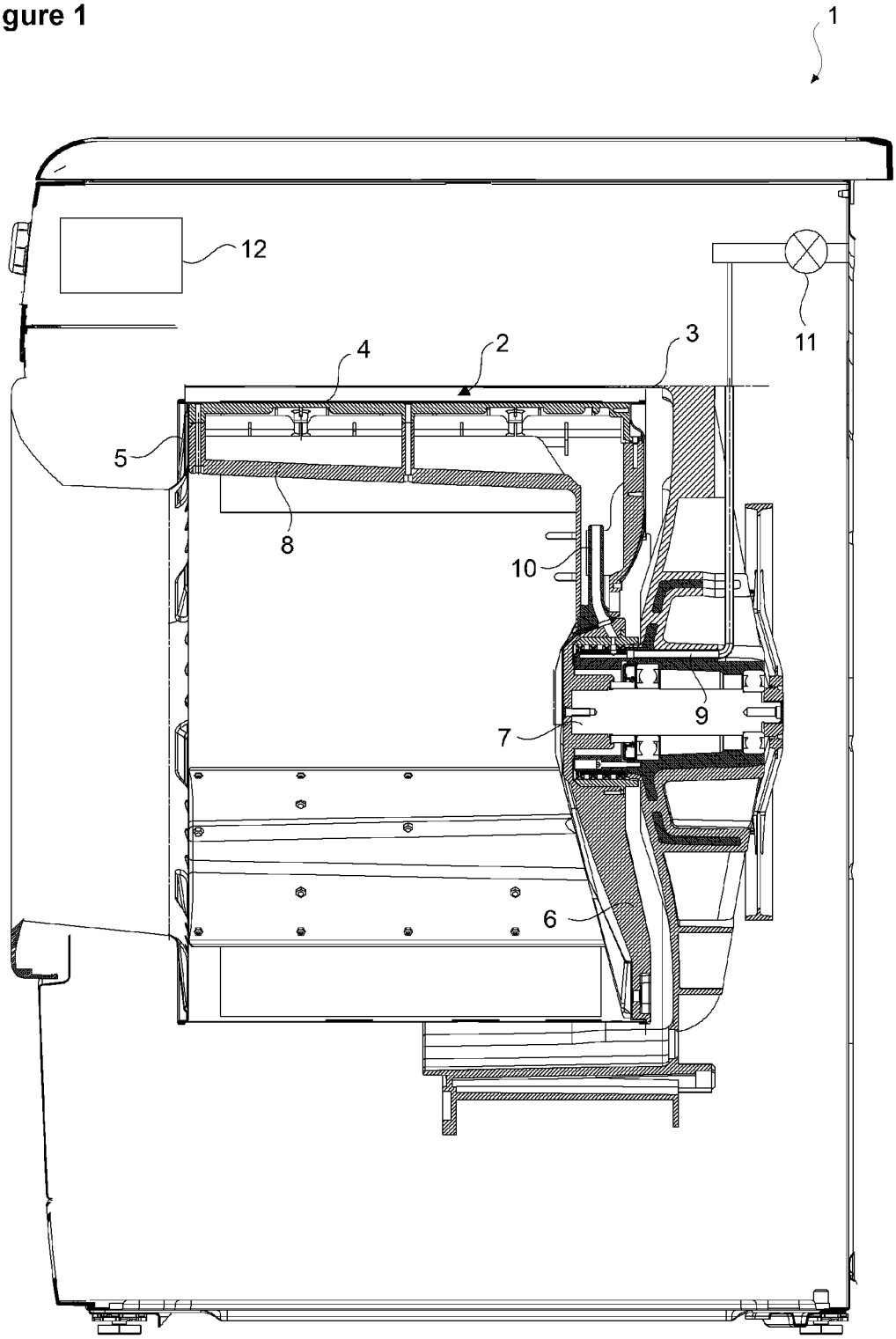

The present invention relates to a washing machine wherein the unbalanced load inside the drum is balanced by using fluid.

In washing machines, the laundry is placed inside a drum that rotates preferably around a horizontal axis. In different steps of the washing program, the laundry is cleaned by means of water and detergent by rotating the drum at different speeds. While the drum is being rotated, the laundry is not distributed homogeneously inside the drum, and causes an uneven distribution of the laundry by piling up in some regions. Particularly in the spin-drying step where the drum is being rotated at very high speeds, the unbalanced distribution of the load causes vibration. These vibrations not only generate noise and result in consumer dissatisfaction but also cause the machine to wear out. Furthermore, the spin-drying performance at high speeds is adversely affected.

In the state of the art, numerous solutions have been developed for balancing the unbalanced load. Of these, a widely used solution is adding weights to the machine and increasing its inertia. However, since the immovable weights complicate the transportation of the machine, in some of the prior art embodiments, adding fluid, mostly water, to the machine is suggested. Water is filled into the baffles secured on the tub or the drum. In a group of embodiments, the fluid is added to the machine after the transportation and the same fluid is used continuously. In another group of embodiments, the fluid required for balancing is taken into the machine while the machine is operating, and discharged at the end of the operation.

In state of the art Japanese Patent Application No. JP2002136792, an additional grooved element is described which bears against the shaft bearing and which provides to direct water to be transferred to the water storage tanks on the drum when there is unbalanced load. This additional element does not rotate and the water in the groove is delivered to the water storage tanks while the shaft bearing rotates by means of a channel.

In the state of the art International Patent Application No. WO2008/125498, delivering water to the chambers in the drum over the bearing wherein the drum shaft is housed for balancing is explained.

The aim of the present invention is the realization of a washing machine wherein the unbalanced load is effectively balanced.

The washing machine realized in order to attain the aim of the present invention, explicated in the first claim and the respective claims thereof, comprises at least one baffle disposed on the inner wall of the drum wherein water is transferred for balancing the unbalanced load occurring in the drum in the spin-drying step.

Walls are provided in the inner volume of the baffle that extend in the radial direction with respect to the drum axis. The walls are disposed on the base of the baffle. Passages are disposed at the upper sections thereof that allow passage of water between the cells separated by the walls. The fluid used in balancing is provided to be distributed inside the baffle by taking into consideration the point where unbalanced load occurs by means of the said partitioned structure formed by the walls at the base of the baffle.

In an embodiment of the present invention, the volumes of the cells arranged inside the baffle between the front cover and the rear cover are equal to each other.

In an embodiment of the present invention, the volumes of the cells arranged inside the baffle between the front cover and the rear cover increase from the middle portion towards the side portions.

In an embodiment of the present invention, the volumes of the cells arranged inside the baffle between the front cover and the rear cover decrease from the middle portion towards the side portions.

In an embodiment of the present invention, the water transferred into the baffle during the balancing process of the unbalanced load opens almost to the middle point between the top end and bottom end of the baffle. In this embodiment, the cells are filled with water from the ones in the middle portion towards the ones on the sides.

In an embodiment of the present invention, the water transferred into the baffle during the balancing process of the unbalanced load opens to two points at the top end and bottom end of the baffle. In this embodiment, the cells are filled with water from the ones on the side portions towards the ones in the middle portion.

In an embodiment of the present invention, during the balancing process of the unbalanced load, the balancing liquid is transferred into each baffle from more than one distribution line supplied by balancing liquid independently from each other. Thus, the cells inside the baffle are provided to be filled in a sequence selected by the control unit depending on the position of the unbalanced load.

In an embodiment of the present invention, the heights of the walls arranged inside the baffle between the front cover and the rear cover are equal to each other.

In an embodiment of the present invention, the heights of the walls arranged inside the baffle between the front cover and the rear cover increase from the middle portion towards the side portions.

In an embodiment of the present invention, the heights of the walls arranged inside the baffle between the front cover and the rear cover decrease from the middle portion towards the side portions.

In an embodiment of the present invention, passage of water is provided between the cells and the channel that remains between the base and the wall.

In an embodiment of the present invention, separators are disposed inside the baffle that extend in the axial direction with respect to the rotational axis of the drum. Passages that allow passage of water between the cells and channels between the base and the cells are disposed in the portions of the separators close to the rotational axis of the drum.

The imbalances occurring as a result of the uneven distribution of the laundry in the drum during the rotation of the drum are balanced by means of the fluid transferred to the baffles on the drum. The distribution of water transferred into the baffles is provided by the walls, the separators disposed inside the baffle and the passages and channels formed therebetween. The compartments formed by the walls extending in the radial direction allow the balancing liquid to be filled into the cells depending on the detected position of the unbalanced load. Consequently, the efficiency of the balancing process is increased.

A washing machine realized in order to attain the aim of the present invention is illustrated in the attached figures, where:

FIG. 1—is the schematic view of a washing machine.

Figure 2:
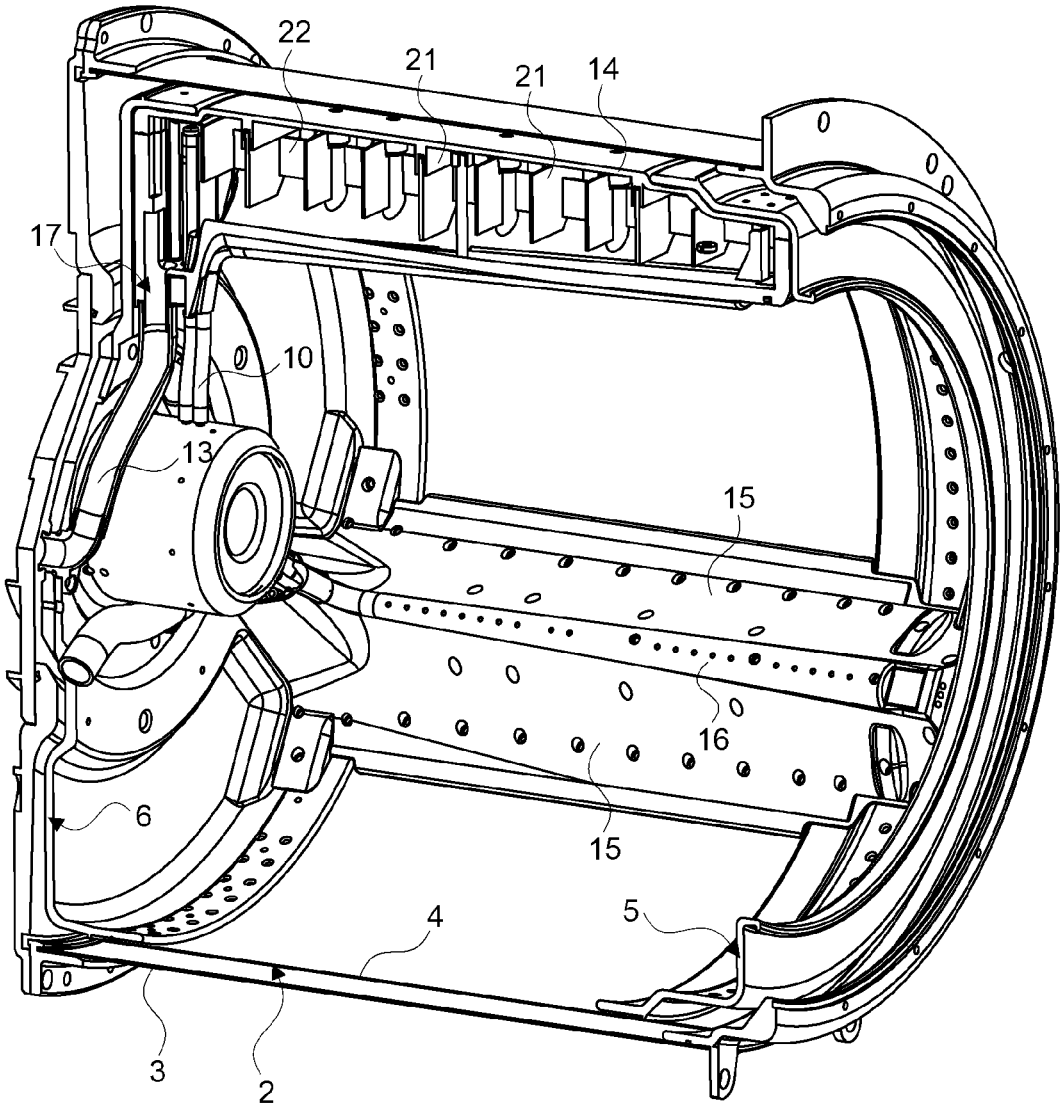

FIG. 2—is the partial cross-sectional view of a drum tub group.

Figure 3:
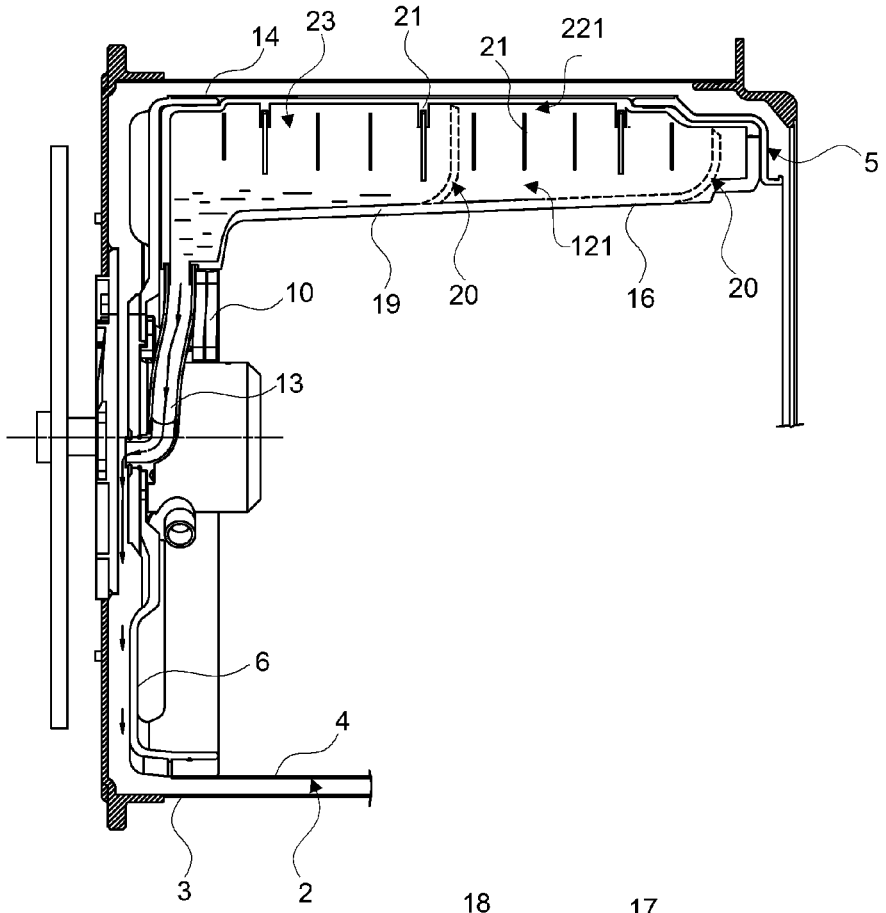

FIG. 3—is the cross-sectional view of a drum tub group.

Figure 4:
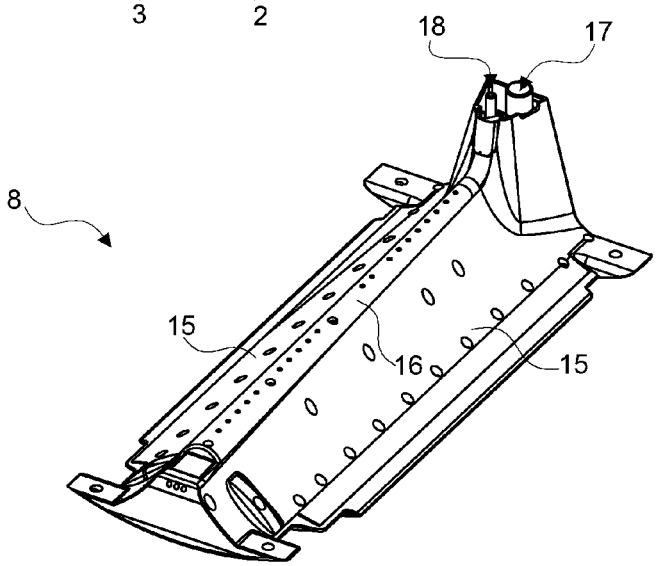

FIG. 4—is the perspective view of a baffle.

Figure 5:
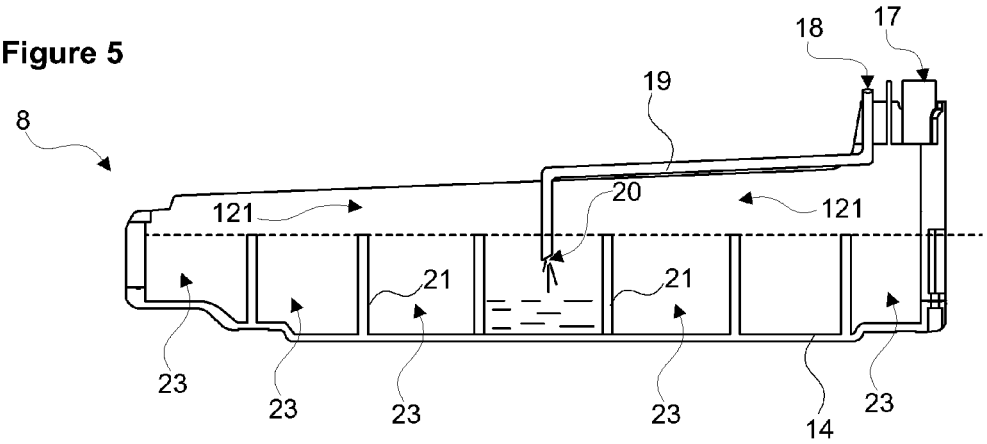

FIG. 5—is the schematic view of the baffle in the first embodiment of the present invention.

Figure 6:
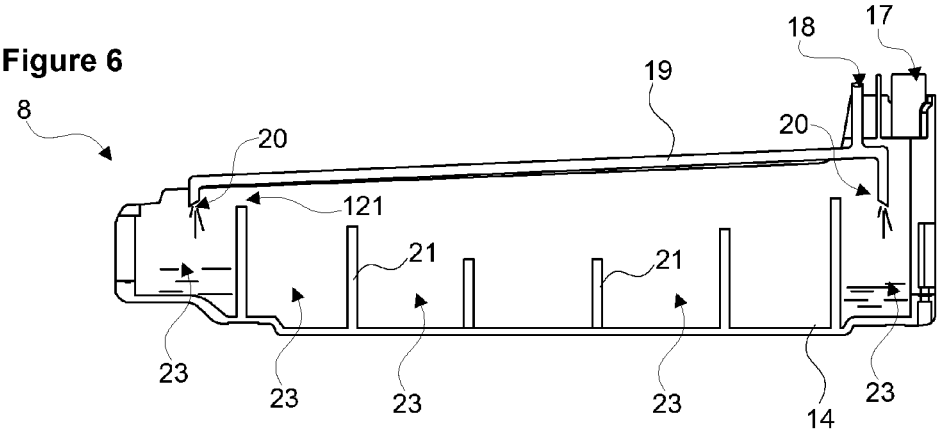

FIG. 6—is the schematic view of the baffle in the second embodiment of the present invention.

Figure 7:
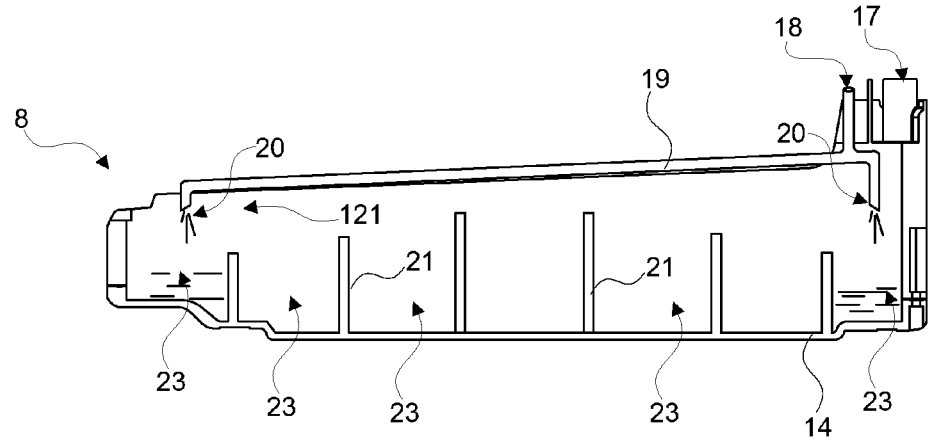

FIG. 7—is the schematic view of the baffle in the third embodiment of the present invention.

Figure 8:
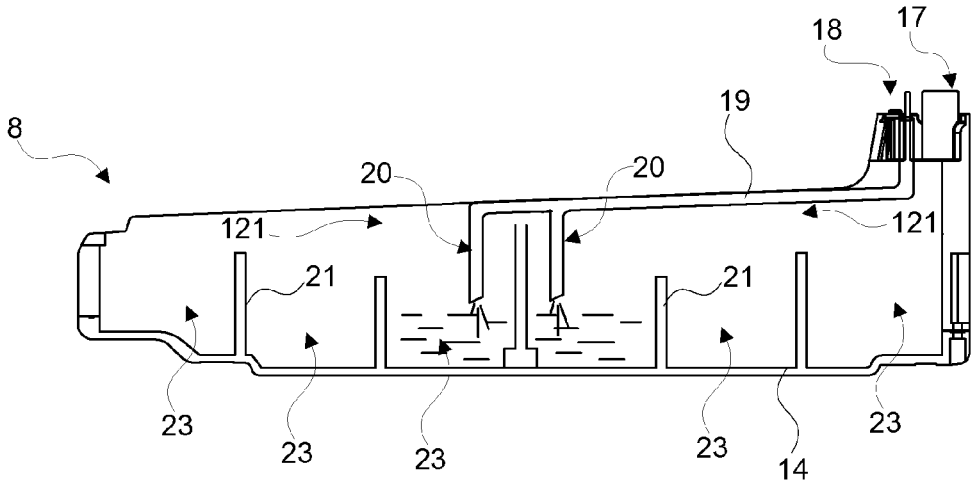

FIG. 8—is the schematic view of the baffle in the fourth embodiment of the present invention.

Figure 9:
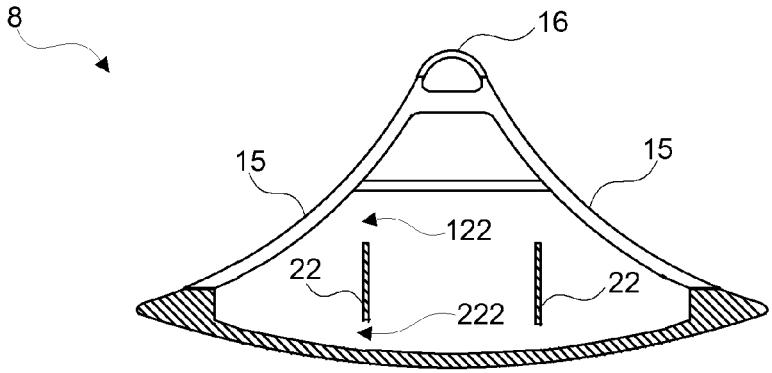

FIG. 9—is the cross-sectional view of a baffle.

The elements illustrated in the figures are numbered as follows:

1. Washing machine
2. Drum
3. Tub
4. Side wall
5. Front cover
6. Rear cover
7. Shaft
8. Baffle
9. Supply line
10. Distribution line
11. Valve
12. Control unit
13. Discharge conduit
14. Base
15. Lateral surface
16. Intersection line
17. Discharge hole
18. Inlet hole
19. Duct
20. Outlet
21. Wall
22. Separator
23. Cell
121, 122. Passage
221, 222. Channel The washing machine (1) of the present invention comprises a drum (2) having a cylindrical side wall (4) formed of a metal plate, a ring shaped front cover (5) and a circular rear cover (6) mounted to the side wall (4), a tub (3) wherein the drum (2) moves and one or more baffles (8) disposed at the inner surface of the side wall (4) wherein liquid is transferred for counterbalancing the unbalanced load when unbalanced load occurs (FIG. 1).

The washing machine (1) comprises at least one supply line (9) connected to the mains, disposed on the rear wall of the tub (3), at least one distribution line (10) disposed on the rear cover (6) with one end opening to the supply line (9) and rotating together with the drum (2) and at least one discharge conduit (13), extending between the baffle (8) and the rear cover (6) providing the water in the baffle (8) to be discharged (FIG. 2 and FIG. 3).

The washing machine (1) furthermore comprises a motor providing the drum (2) to rotate, a shaft (7) transmitting the movement received from the motor to the drum (2) and bearing on the tub (3), at least one valve (11) disposed on the supply line (9) and providing to controllably receive water from the mains to the supply line (9) and a control unit (12) that determines which baffle (8) receives how much water by opening/closing the valves (11) by determining the amount and position of the unbalanced load when unbalanced load is detected (FIG. 1).

When the washing machine (1) is operated, the baffle (8) and the distribution line (10) also rotate together with the drum (2). When unbalanced load is detected by the control unit (12), the amount and position of the unbalanced load is determined and the control unit (12) decides how much water is required to be received into which baffle (8) on the drum (2). The control unit (12) provides the determined amount of water to be directed to the baffles (8) at the determined time by opening/closing the valves (11). According to this decision, the valve (11) situated on the supply line (9) that is connected to the mains opens. Water flowing through the supply line (9) reaches the supply line (9) outlet and is directed from the supply line (9) outlet to the inlet of the water distribution line (10). The water received into the distribution line (10) reaches the respective baffle (8).

The baffle (8) comprises a base (14) seated on the side wall (4), two lateral surfaces (15) intersecting each other and extending from the base (14) towards the drum (2) center and an intersection line (16) where the lateral surfaces (15) are joined. The baffle (8) is disposed on the inner wall of the side wall (4) so as to extend between the front cover (5) and the rear cover (6). The baffle (8) provides the laundry to be moved inside the drum (2) during the washing process (FIG. 4 and FIG. 9).

The washing machine (1) comprises a discharge hole (17) disposed at the portion where the baffle (8) joins with the rear cover (6), opening to the inner volume of the baffle (8) and whereto the discharge conduit (13) is connected and an inlet hole (18) disposed at the portion where the baffle (8) joins with the rear cover (6) opening to the inner volume of the baffle (8) and whereto the distribution line (10) is joined. The discharge hole (17) is almost at the same level with the intersection line (16) with respect to the base (14). Thus, the water filled into the baffle (8) is easily directed to the discharge conduit (13) with the effect of gravity when the drum (2) slows down at the end of the spin-drying process. Furthermore, the water in the baffle (8) being directed to the discharge hole (17) is facilitated by means of the intersection line (16) configured to be inclined from the front cover (5) towards the rear cover (6) (FIG. 3).

The washing machine (1) furthermore comprises a duct (19) connected to the inlet hole (18), extending inside the baffle (8) at least partially along the intersection line (16) and at least one outlet (20) situated on the duct (19). The inlet hole (18) is almost at the same level with the intersection line (16) with respect to the base (14). Thus, the connection between the duct (19) and the inlet hole (18) is provided to be made directly. By means of the duct (19) extending along the intersection line (16), the water transferred into the baffle (8) during the spin-drying process is provided to be sprayed towards the base (14) without being affected by the level of water inside the baffle (8).

The washing machine (1) furthermore comprises at least one wall (21) extending from the base (14) in the radial direction with respect to the rotational axis of the drum (2), at least two cells (23) separated from each other by the walls (21) and a passage (121) remaining between the wall (21) and the lateral surface (15). The cells (23) are arranged in the axial direction from the front cover (5) towards the rear cover (6) (FIG. 3).

In another embodiment of the present invention, the washing machine (1) comprises cells (23) the volumes of which are equal.

In another embodiment of the present invention, the washing machine (1) comprises at least three cells (23) the volumes of which decrease from the cell (23) near the midpoint between the front cover (5) and the rear cover (6) towards the front cover (5) and the rear cover (6).

In another embodiment of the present invention, the washing machine (1) comprises at least three cells (23) the volumes of which increase from the cell (23) near the midpoint between the front cover (5) and the rear cover (6) towards the front cover (5) and the rear cover (6).

In an embodiment of the present invention, the washing machine (1) comprises the outlet (20) that opens over the cell (23) that is at the midpoint of the distance between the front cover (5) and the rear cover (6). Water transferred from the duct (19) into the baffle (8) by the outlet (20), first fills in the cell (23) that is at the midpoint of the distance between the front cover (5) and the rear cover (6), the water added after the water in the cell (23) reaches the level of the walls (21) bounding the cell (23), fills in the other cells (23) adjacent to the said cell (23) by passing through the passages (121). Thus, the water transferred into the baffle (8) first is collected at the center of the baffle (8) and as water is continued to be added also fills in the portions of the space in the baffle (8) towards the front cover (5) and the rear cover (6) (FIG. 5 and FIG. 8).

In another embodiment of the present invention, the washing machine (1) comprises two outlets (20), one of which opens over the cell (23) nearest the front cover (5) and the other over the cell (23) nearest the rear cover (6). Water transferred from the duct (19) into the baffle (8) by the outlet (20), first fills in the cell (23) nearest the front cover (5) and the cell (23) nearest the rear cover (6), the water added after the water in the cell (23) reaches the level of the walls (21) bounding the cell (23), fills in the other cells (23) adjacent to the said cell (23) by passing through the passages (121). Thus, the water transferred into the baffle (8) first is collected at the end points of the baffle (8) close the front cover (5) and the rear cover (6) and as water is continued to be added also fills in the space in the baffle (8) at the middle portions of the front cover (5) and the rear cover (6) (FIG. 6 and FIG. 7).

In another embodiment of the present invention, the washing machine (1) comprises two outlets (20) in each baffle (8), one opening over the cell (23) nearest the front cover (5), the other over the cell (23) nearest the rear cover (6), two ducts (19) separate from each other, supplying the said outlets (20) and two distribution lines (10) whereto the said ducts (19) are connected. Consequently, it is possible to transfer balancing fluid by the control unit (12) only to the cell (23) closest to the front cover (5) or to the cell (23) closest to the rear cover (6) in any one of the baffles (8) depending on the position of the detected unbalanced load.

In an embodiment of the present invention, the washing machine (1) comprises at least two walls (21) with the heights equal to each other, that extend parallel to each other and to the rear cover (6) (FIG. 5).

In another embodiment of the present invention, the washing machine (1) comprises at least three walls (21) arranged parallel to each other and the rear cover (6), the heights of which decrease from the wall (21) near the midpoint between the front cover (5) and the rear cover (6) towards the front cover (5) and the rear cover (6) (FIG. 7).

In another embodiment of the present invention, the washing machine (1) comprises at least three walls (21) arranged parallel to each other and the rear cover (6), the heights of which increase from the wall (21) near the midpoint between the front cover (5) and the rear cover (6) towards the front cover (5) and the rear cover (6) (FIG. 6).

In an embodiment of the present invention, the washing machine (1) comprises a channel (221) disposed between the wall (21) and the base (14) (FIG. 3).

In another embodiment of the present invention, the washing machine (1) furthermore comprises at least one separator (22) that extends from the base (14) in the axial direction with respect to the rotational axis of the drum (2) and a passage (122) that remains between the separator (22) and the lateral surface (15) (FIG. 9).

In an embodiment of the present invention, the washing machine (1) comprises a channel (222) disposed between the separator (22) and the base (14) (FIG. 9).

In an embodiment of the present invention, three baffles (8) are situated on the drum (2) having 120° angles therebetween, three supply lines (9) on the tub (3) and three distribution lines (10) on the rear cover (6). Accordingly, depending on which baffle (8) water is intended to be delivered, the valve (11) on the supply line (9) that delivers water to that baffle (8) is opened.

By means of the present invention, in the case when unbalanced load is detected by the control unit (12), transferring the required amount of water mechanically and continuously to the desired baffle (8) for decreasing the effect to a minimum by counterbalancing the unbalanced load is made possible.

It is to be understood that the present invention is not limited to the embodiments disclosed above and a person skilled in the art can easily introduce different embodiments. These should be considered within the scope of the protection postulated by the claims of the present invention.

The invention claimed is:

1. A washing machine (1) comprising:

a drum (2) having a cylindrical side wall (4) formed of a metal plate, a ring shaped front cover (5) and a circular rear cover (6) mounted to the side wall (4), a tub (3) wherein the drum (2) moves, and the drum having one or more baffles (8) disposed at the inner surface of the side wall (4) wherein liquid is transferred for counterbalancing an unbalanced load an amount and position of the unbalanced load is detected by a control unit (12), the one or more baffles (8) further having a base (14) seated on the side wall (4), and having two lateral surfaces (15) extending from the base (14) towards the drum (2) center and having at least one supply line (9) connected to the mains, disposed on the rear wall of the tub (3), and having at least one distribution line (10) disposed on the rear cover (6) and rotating together with the drum (2), and having at least one discharge conduit (13), providing the water in the baffle (8) to be discharged, and having a discharge hole (17) disposed where the baffle (8) joins with the rear cover (6), opening to the inner volume of the baffle (8), whereto the discharge conduit (13) is joined, and an inlet hole (18) disposed at the portion where the baffle (8) joins with the rear cover (6) opening to the inner volume of the baffle (8) and whereto the distribution line (10) is joined, and wherein there is at least one wall (21) extending from the base (14) in the radial direction with respect to the rotational axis of the drum (2), at least two cells (23) separated from each other by the walls (21) and a passage (121) that remains between the wall (21) and the lateral surface (15) And wherein the two lateral surfaces (15) intersecting each other and being joined in an intersection line (16), the at least one discharge conduit (13) extending between the baffle (8) and the rear cover (6), a duct (19) connected to the inlet hole (18), extending inside the baffle (8) at least partially along the intersection line (16) and at least one outlet (20) situated on the duct (19), and one end of the distribution line (10) opening to the supply line (9).

2. The washing machine (1) as in claim 1, wherein the cells (23) that are arranged in the axial direction from the front cover (5) towards the rear cover (6).

3. The washing machine (1) as in claim 1 or 2, wherein the cells (23) the volumes of which are equal to each other.

4. The washing machine (1) as in claim 1 or 2, wherein the at least two cells are at least three cells (23) the volumes of which decrease from the cell (23) near the midpoint between the front cover (5) and the rear cover (6), towards the front cover (5) and the rear cover (6).

5. The washing machine (1) as in claim 1 or 2, wherein the at least two cells are at least three cells (23) the volumes of which increase from the cell (23) near the midpoint between the front cover (5) and the rear cover (6) towards the front cover (5) and the rear cover (6).

6. The washing machine (1) as in claim 1, wherein the at least one outlet (20) that opens over the cell (23) at the midpoint of the distance between the front cover (5) and the rear cover (6).

7. The washing machine (1) as in claim 6, wherein the at least one outlet is two outlets (20), one of which opens over the cell (23) nearest the front cover (5) and the other over the cell (23) nearest the rear cover (6).

8. The washing machine (1) as in claim 6, wherein the at least one outlet is two outlets (20) in each baffle (8), one opening over the cell (23) nearest the front cover (5), the other over the cell (23) nearest the rear cover (6), two ducts (19) separate from each other, supplying the said outlets (20) and two distribution lines (10) whereto the said ducts (19) are connected.

9. The washing machine (1) as in claim 6, wherein the at least one wall is at least two walls (21) with the heights equal to each other, that extend parallel to each other and to the rear cover (6).

10. The washing machine (1) as in claim 6, wherein the at least one wall is at least three walls (21) arranged parallel to each other and the rear cover (6), the heights of which decrease from the wall (21) near the midpoint between the front cover (5) and the rear cover (6) towards the front cover (5) and the rear cover (6).

11. The washing machine (1) as in claim 6, wherein the at least one wall is by at least three walls (21) arranged parallel to each other and the rear cover (6), the heights of which increase from the wall (21) near the midpoint between the front cover (5) and the rear cover (6) towards the front cover (5) and the rear cover (6).

12. The washing machine (1) as in claim 6, wherein further comprising a channel (221) disposed between the wall (21) and the base (14).

13. The washing machine (1) as in claim 6, wherein further comprising by at least one separator (22) that extends from the base (14) in the axial direction with respect to the rotational axis of the drum (2) and a passage (122) that remains between the separator (22) and the lateral surface (15).

14. The machine (1) as in claim 13, further comprising a channel (222) that is disposed between the separator (22) and the base (14).

15. The washing machine (1) as in claim 6, wherein the discharge hole (17) that is almost at the same level with the intersection line (16) with respect to the base (14) and the intersection line (16) that is configured to be inclined from the front cover (5) towards the rear cover (6).

* * * * *